US008818256B2

(12) United States Patent
Herrmann et al.

(10) Patent No.: US 8,818,256 B2
(45) Date of Patent: Aug. 26, 2014

(54) PHOTOCOPIER

(75) Inventors: William Herrmann, Boise, ID (US); Bradley J. Anderson, Boise, ID (US); Leonard Schroath, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 2168 days.

(21) Appl. No.: 11/714,971

(22) Filed: Mar. 7, 2007

(65) Prior Publication Data

US 2008/0219731 A1 Sep. 11, 2008

(51) Int. Cl.
*G03G 15/00* (2006.01)

(52) U.S. Cl.
CPC ..... *G03G 15/6538* (2013.01); *G03G 15/602* (2013.01); *G03G 2215/00928* (2013.01)
USPC ..... 399/363; 399/367; 399/368; 399/369

(58) Field of Classification Search
CPC ..... G03G 15/602; G03G 2215/00928; B41J 13/0036; H04N 1/32496
USPC ..... 399/367, 368, 369, 363
See application file for complete search history.

(56) References Cited

U.S. PATENT DOCUMENTS

| | | | | |
|---|---|---|---|---|
| 4,433,837 | A * | 2/1984 | Romanowski | 271/293 |
| 4,630,921 | A | 12/1986 | Watanabe | |
| 5,416,570 | A | 5/1995 | Kondou | |
| 5,982,510 | A * | 11/1999 | Funahashi | 358/468 |
| 6,181,884 | B1 * | 1/2001 | Isogai et al. | 399/1 |

* cited by examiner

*Primary Examiner* — Matthew G Marini
*Assistant Examiner* — Allister Primo

(57) ABSTRACT

A photocopier apparatus includes a scanning module configured to scan an original document; a printing module configured to print a copy of the original document using output from the scanning module; and a media feed path configured to transport the original document and the copy to a single output receptacle.

14 Claims, 7 Drawing Sheets

PHOTOCOPIER

BACKGROUND

Photocopiers are used by millions of people every day to create printed copies of original documents. In a typical photocopier, the original document is photographed or scanned to create a latent image or digital data representing the document that can be used by a printing device or print engine to produce copies of the scanned document.

In recent years, the photocopying process has become increasingly more automated and efficient. Photocopier devices commonly come equipped with automated media transport paths. These paths transport blank media through the printing process of the photocopier and to output trays configured to hold the finished document copy or copies. In some photocopier devices, original document pages are manually placed on a scanning surface and removed from the scanning surface by a user. However, some of today's photocopier devices also use media transport paths to transport original documents, page by page, through the scanning process to an output tray that is separate from the output tray(s) to which the finished photocopies are transported.

Whether an original document is manually removed from the photocopier device or automatically transported through the photocopying device to an output tray, the original document and photocopies of the original document are generally kept separate throughout the photocopying process and end up in different locations after the copying process. As such, it is often the case that users forget to retrieve their original documents when photocopies are made. Forgotten or discarded original documents in a photocopier may result in unnecessary inconvenience, additional costs, and/or breaches of security.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

In some cases, it may be desirable for a photocopier device to reduce the likelihood that a user will discard or forget an original document after photocopies are made of that original document. The present specification provides apparatus and methods relating to photocopier devices that direct original documents and photocopied documents to a common output receptacle, thus significantly reducing the likelihood that a user will forget or discard the original documents.

As used in the present specification and in the appended claims, the term "original document" refers to a hardcopy document that is scanned or otherwise copied by a photocopying apparatus to provide photocopies thereof.

As used in the present specification and in the appended claims, the term "module" refers to a component of a system or apparatus that has a specific function and the ability to interface with other components of the system or apparatus. Generally, a module is a functional unit of electrical components or a combination of electrical components and software.

As used in the present specification and in the appended claims, the term "media feed path" refers to a system of components configured to transport print media through a specified portion of a photocopier device. As used herein, media feed path components may include, but are not limited to, drums, belts, wheels, rollers, gears, vacuum devices, stepper motors, servo motors, and combinations thereof.

In the following description, for purposes of explanation, numerous specific details are set forth in order to provide a thorough understanding of the present systems and methods. It will be apparent, however, to one skilled in the art that the present systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

The principles disclosed herein will now be discussed with respect to exemplary photocopier apparatus and methods for producing photocopies.

Exemplary Photocopier Apparatus

Figure 1:
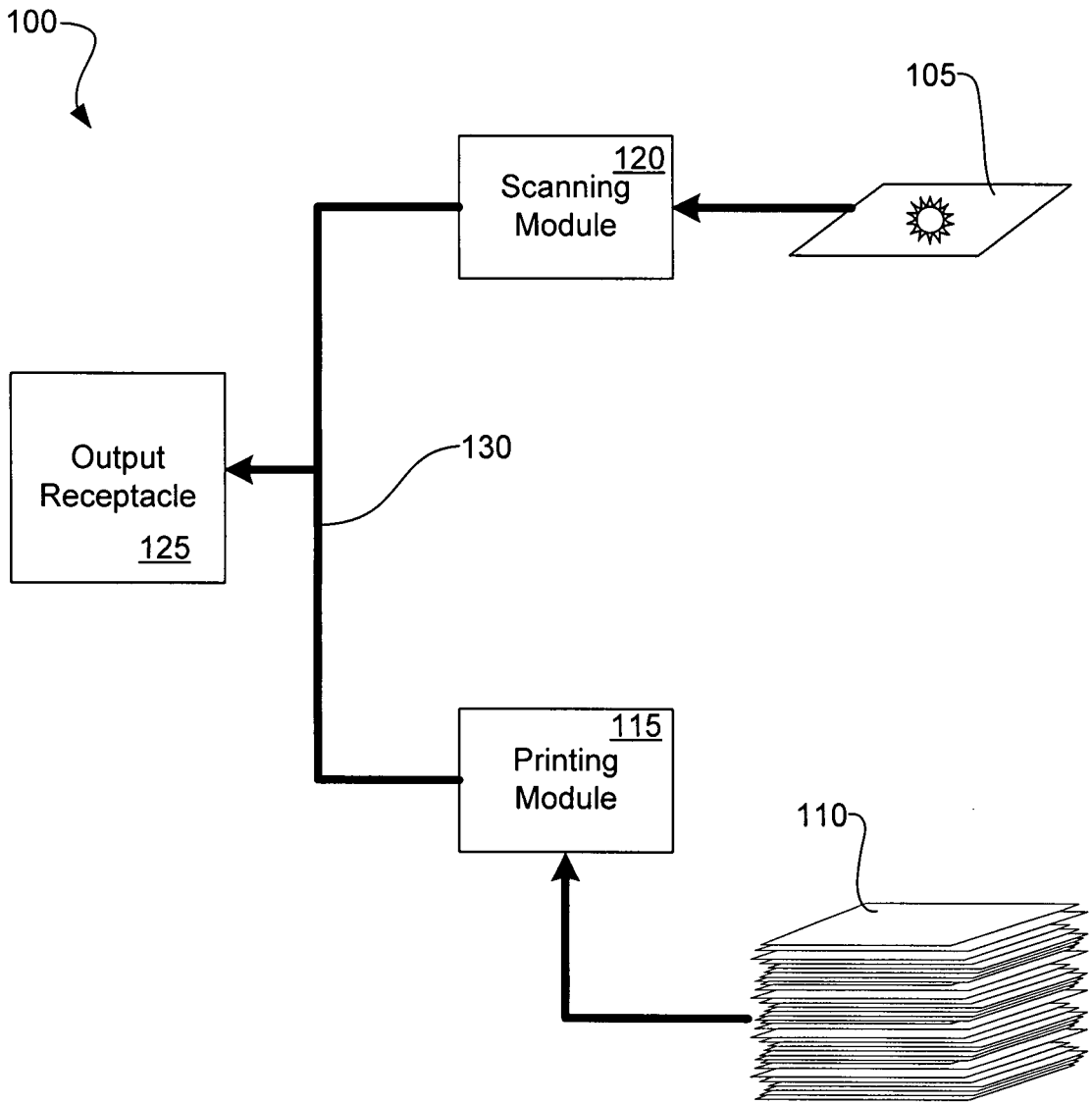
FIG. 1 is a diagram of an exemplary photocopier apparatus according to principles described herein.

Referring now to FIG. 1, an exemplary photocopier apparatus (100) comprises a scanning module (120), a printing module (115), a media feed path (130), and an output receptacle (125).

In the figure, a diagram of media flow through the exemplary photocopier apparatus (100) is shown. In this particular embodiment, the media include an original document page (105) and blank print media (110). The media flow is illustrated with dark arrows. The original document page (105) is received into the scanning module (120) of the exemplary photocopier apparatus (100).

The scanning module (120) is configured to produce a scanned electronic image of the original document page (105). As such, the scanning module (120) may comprise, but is not limited to, charged-coupled devices, mirrors, scan heads, glass plates, lamps, lenses, covers, filters, stepper motors, stabilizer bars, belts, power supplies, interface ports, control circuitry, memory, photomultiplier tubes, combinations thereof, and the like. The scanning module (120) may obtain the scanned image by measuring light directed to, and reflected from, the original document page (105). The scanned image may then be converted to digital data and stored, for example, in random access memory (RAM). In other embodiments, the scanned image may be stored as a pattern of static charge on a drum in the photocopier apparatus (100).

Upon leaving the scanning module (120) the media feed path (130) may transport the original document page (105) to the output receptacle (125) of the photocopier apparatus (100). In some embodiments, the output receptacle (125) comprises a tray, on which media (105, 110) may be stacked as it exits the scanning module (120) and/or printing module (115).

At least one page of the blank print media (110) is received into the printing module (115). The printing module (115) is configured to impart a printed image representative of the scanned image of the original document page (105) on the page of blank print media (110). In some embodiments, the printed image is a full-scale replica of the original document page (105). In other embodiments, the printed image may comprise scaled, cropped, and/or otherwise modified representations of the original document page (105).

The printing module (115) may be configured to use any of a variety of existing printing technologies to impart the printed image representative of the scanned image onto the page of print media (110). For example, the printing module (115) may comprise dry electrophotography, liquid electrophotography, laser, inkjet, and/or other printing systems. The printing module (115) may further comprise an electronic interface with the scanning module (120) to receive data corresponding to at least a portion of the scanned image. The data received from the scanning module (120) may be converted into a print-ready format recognized by the printing module (115).

In some embodiments, once the data have been received from the scanning module (120), multiple copies may be made of, or pages of print media (110) may be printed with, the image representative of the scanned original document (105). In other embodiments, the original document page (105) must be scanned for each page of print media (110) that is printed with an image corresponding to the original document page (105).

After the printing module (115) has imparted the printed image representative of the scanned image on the page of print media (110), the page of print media (110) is transported by the media feed path (130) to the output receptacle (125).

Due to the tendency of many photocopier users to focus their attention on the arrival of the printed copies they are making in the output trays of the photocopiers, those users may forget to retrieve the original document. Consequently, the photocopier apparatus (100) of the present specification may assist the user in remembering to collect his or her original document by causing the original document to exit the photocopier apparatus (100) into the same output receptacle (125) or tray as the copy, or one of the copies, of the original document that the photocopier (100) has made. Consequently, the user may retrieve both the original document page (105) and its copy or copies in one stack, thereby eliminating the probability that he or she will forget or discard the original document page (105).

In some embodiments, the original document may comprise a plurality of pages. Each of the plurality of pages may enter the scanning module (120) either manually or through an automatic document feeder that systematically and sequentially loads pages of the original document into the scanning module (120). In these embodiments, a new page may be loaded from the original document every time an original document page (105) is output by the scanning module (120) into the media feed path (130) until all pages of the original document have been received into the scanning module (120) and passed through the media feed path (130) to the output receptacle (125).

In embodiments where the original document comprises a plurality of pages, the photocopier apparatus (100) may be configured to transport all of the original document pages to the output receptacle (125) before or after depositing the copy or copies of the original document in the output receptacle (125). In this way, a user may maintain his or her original document pages separate from photocopied pages while still retrieving all of the pages of both the original and copied documents from the same output receptacle (125).

Figure 2:
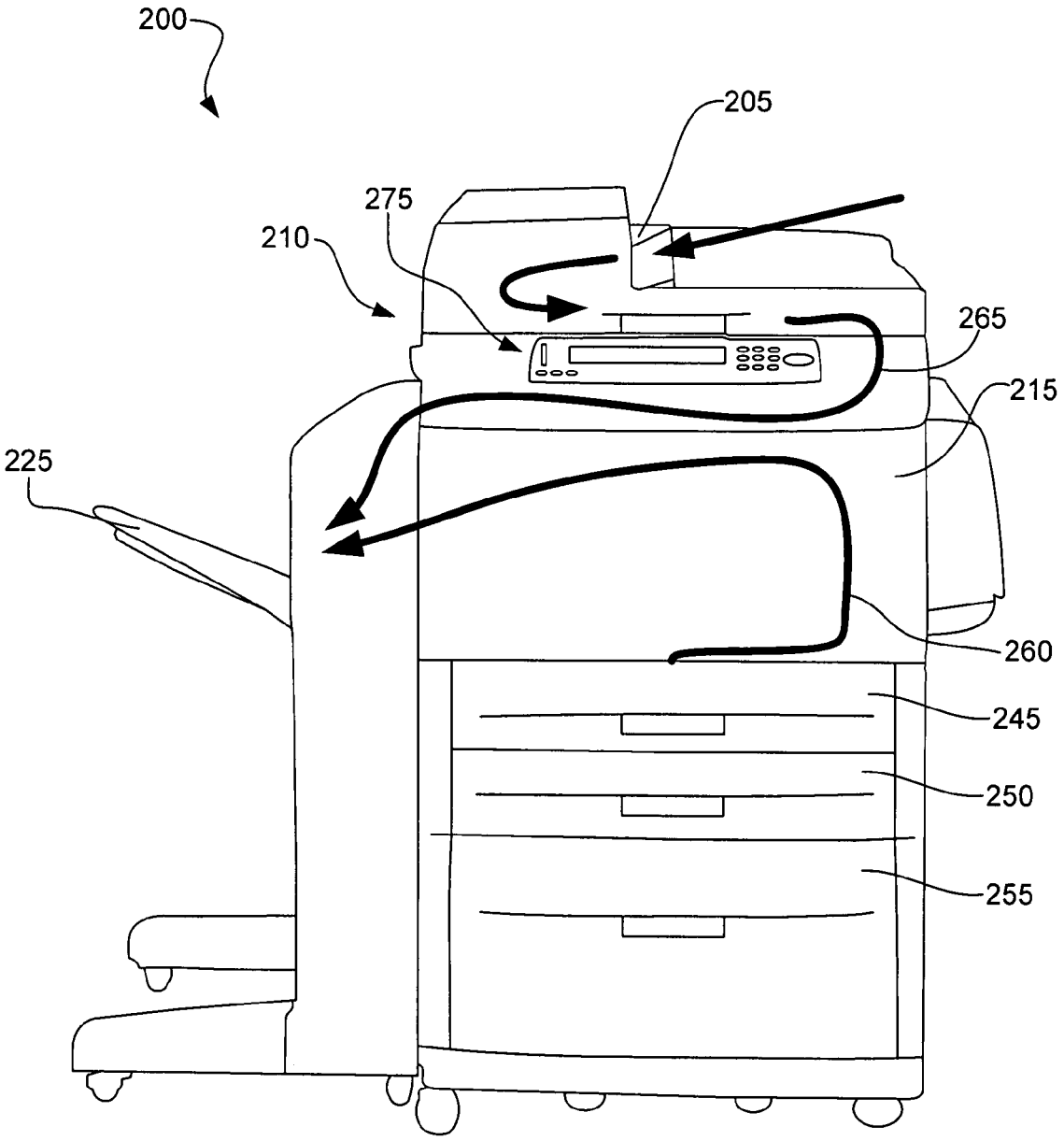
FIG. 2 is an illustration of an exemplary photocopier apparatus according to principles described herein.

Referring now to FIG. 2, an exemplary photocopier apparatus (200) is shown. The exemplary photocopier apparatus (200) corresponds to the diagram of FIG. 1. The photocopier apparatus (200) comprises an automatic document feeder (205) through which one or more original document pages (105, FIG. 1) may be loaded into a scanning portion (210) of the photocopier (200). Many, but not necessarily all, of the components of the scanning module (120, FIG. 1) may generally occupy the scanning portion (210) of the photocopier apparatus (200). A first portion (265) of an exemplary media feed path may transport an original document page from the scanning portion (210) to an output tray (225).

A printing portion (215) of the exemplary photocopier apparatus (200) may receive blank print media from one of three media trays (245, 250, 255) shown. In other embodiments, photocopier devices of the present specification may comprise more or fewer media supply trays than are shown in this exemplary embodiment. A second portion (260) of the exemplary media feed path may transport the blank print media through the printing portion (215) of the photocopier apparatus (200) and to the same output tray (225).

A user may set photocopy parameters and change settings on the photocopier apparatus (200) through an interactive menu of a user interface (275) that may comprise buttons and a screen or other user interface devices. In some embodiments, the user interface (275) may comprise a touch-sensitive screen.

Additionally, the photocopier apparatus (200) may comprise page sorting and management devices. Examples of page sorting and management devices that may be used in a photocopier apparatus (200) of the present specification include, but are not limited to, page collation devices, page alignment devices, page stapling devices, hole punching devices, page orienting devices, the like, and combinations thereof.

Figure 3:
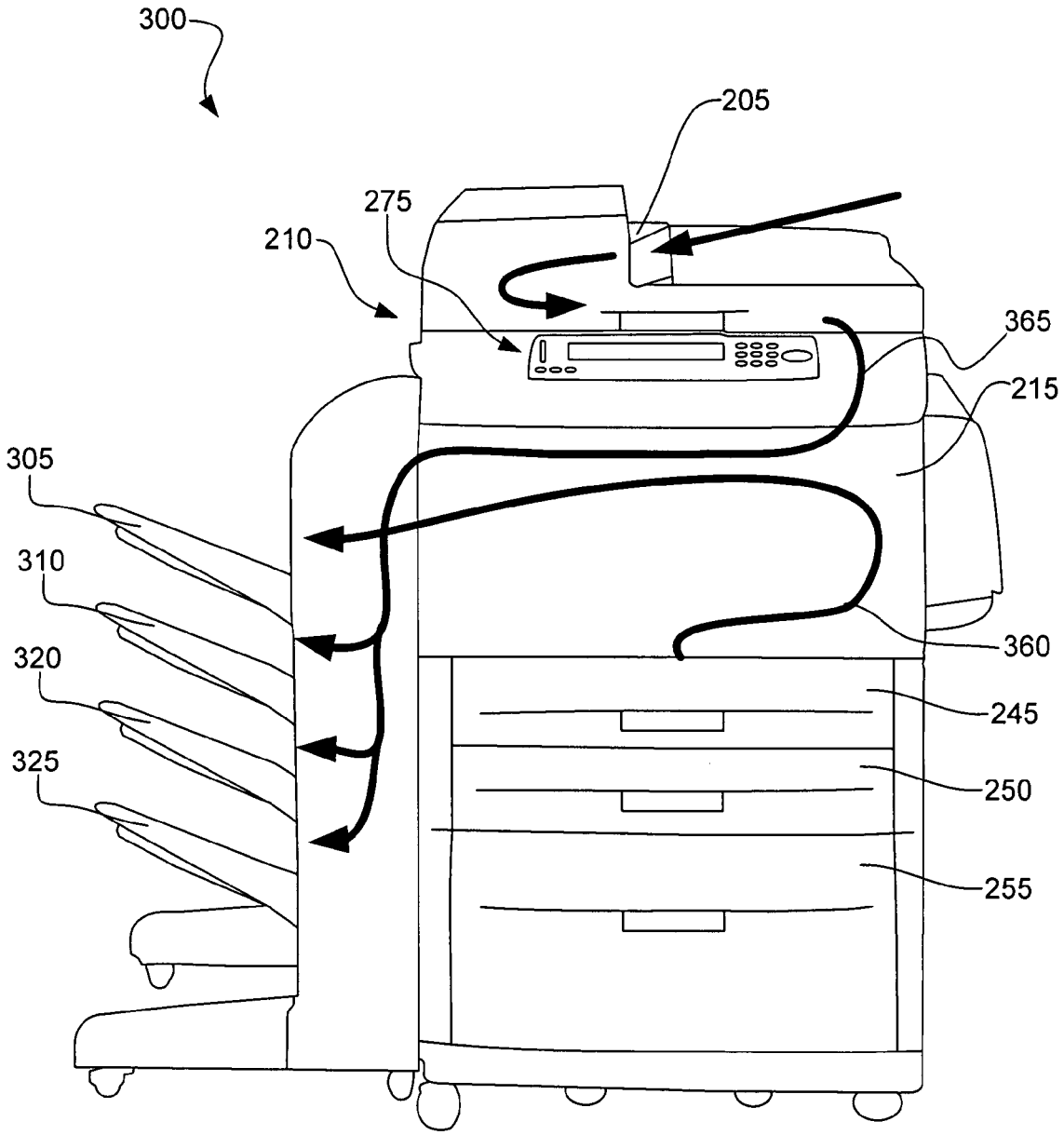
FIG. 3 is an illustration of an exemplary photocopier apparatus, according to principles described herein.

Referring now to FIG. 3, an exemplary photocopier apparatus (300) is shown. The exemplary photocopier apparatus (300) comprises a plurality of output trays (305, 310, 320, 325). As such, the media feed paths of the exemplary photocopier apparatus (300) are configured to transport original documents and print media bearing copies of the original document to any one or all of the media output trays (305, 310, 320, 325). One media feed path (365) transports original document pages from the scanning portion (210) to any of the output trays (305, 310, 320, 325). A second media feed path (360) transports blank media from any of a number of supply trays (245, 250, 255) through the printing portion (215) and to any of the output trays (305, 310, 320, 325).

In one exemplary embodiment, different pages of an original document with their accompanying photocopies may be sorted into different media output trays (305, 310, 320, 325). In another exemplary embodiment, separate multipage original documents may be output to separate media output trays (305, 310, 320, 325). The original document may be transported by the transport path (365) to any of the output trays (305, 310, 320, 325) where one or more copies of the original are also being deposited so that the original can be retrieved with the one or more copies in that same output receptacle. In some embodiments, the user may select, using the interface (275) to which of the output trays (305, 210, 320, 325) the original document along with at least one copy of the original document will be deposited.

Figure 4:
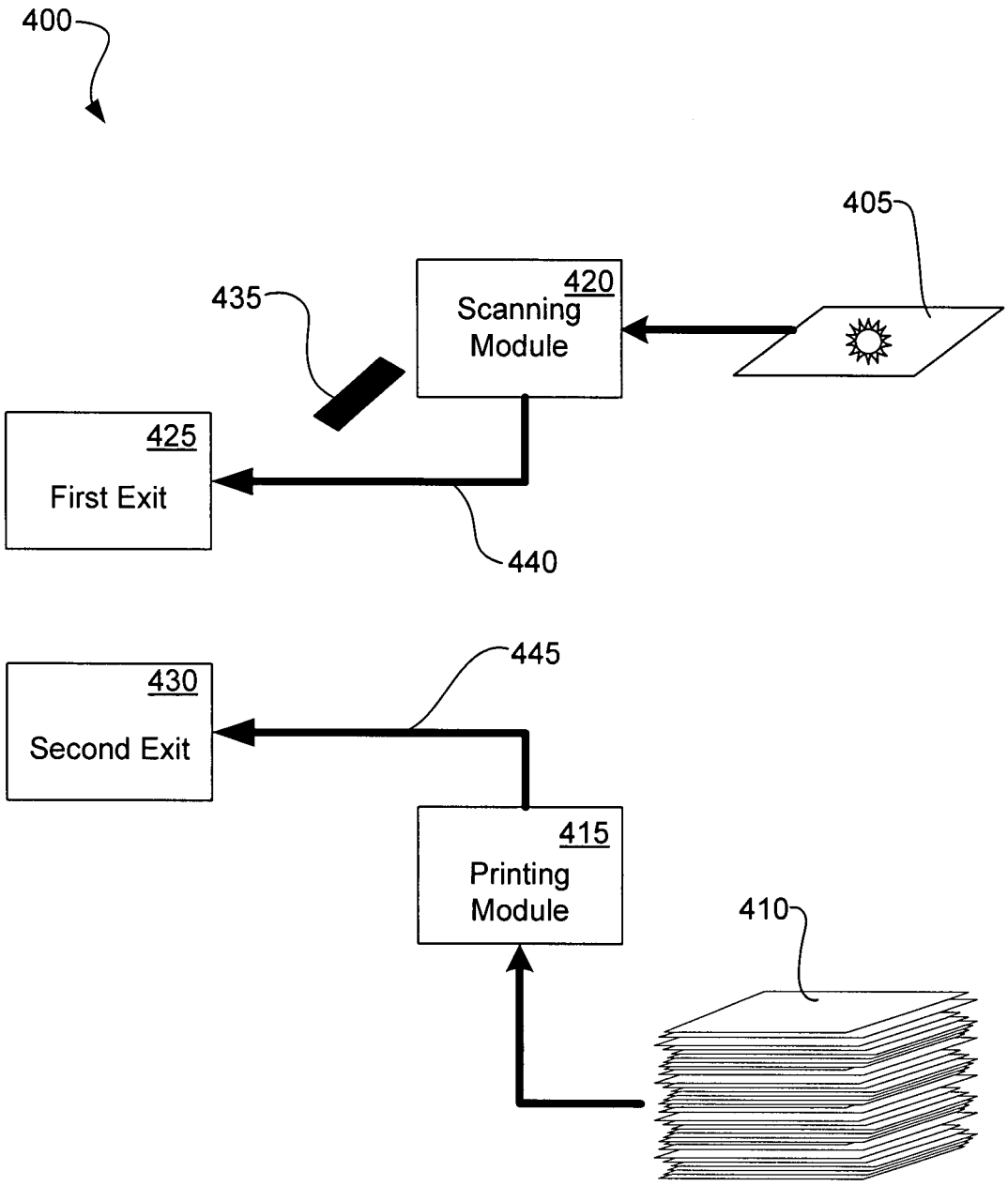
FIG. 4 is a diagram of an exemplary photocopier apparatus according to principles described herein.

Referring now to FIG. 4, a diagram of another exemplary photocopier apparatus (400) is shown. In some embodiments, it may be desirable to modify an existing photocopier apparatus such that the photocopier apparatus (400) outputs original documents and their corresponding photocopies to the same output tray. In other cases, it may be desirable to provide a photocopier apparatus equipped to selectively output original documents to a separate tray for originals or to the same output trays to which corresponding photocopies of the original are output. For both of the aforementioned scenarios, a diverter device (435) may be included in a photocopier apparatus (400) comprising an original document feed path (440) having a first exit (425) and a photocopy feed path (445) having a second exit (430). The second exit (430) is distinct from the first exit. The first and second exits may comprise output receptacles in the photocopier apparatus (400) such as trays. The diverter device (435) is configured to divert a document from the original document feed path (440) to exit the photocopier apparatus at the second exit (430).

In the embodiment of FIG. 4, the diverter device (435) comprises an engaged setting and a disengaged setting and may be selectively engaged or disengaged according to user preferences. When disengaged, as shown in the present figure, an original document (405) received into a scanning module (420) is transported from the scanning module (420) to the first exit (425) through the original document feed path (440). Blank media (410) receive an image representative of the original document (405) from a printing module (415) and are transported to the second exit (430) by the photocopy feed path (445).

Figure 5:
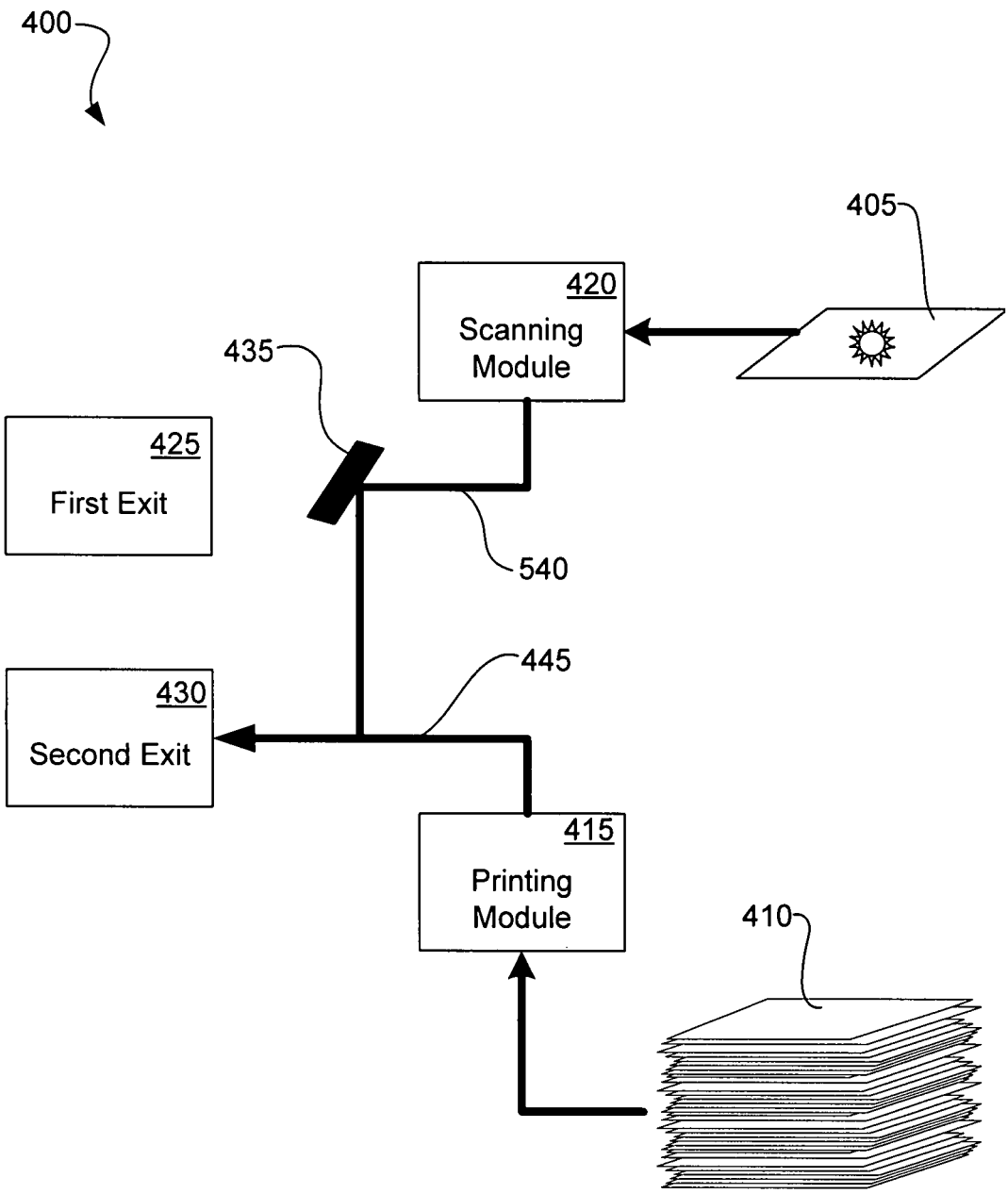
FIG. 5 is a diagram of an exemplary photocopier apparatus according to principles described herein.

Referring now to FIG. 5, the photocopier apparatus (400) of FIG. 4 is shown with the diverter device (435) in an engaged setting. When engaged, the diverter device (435) prevents the original document from exiting the photocopier apparatus (400) at the first exit and provides a modified original document feed path (540) which exits the photocopier apparatus (400) at the second exit (430). In this way, an original document (405) may be retrieved from the same output receptacle with the photocopied print media (410), thus reducing the likelihood that a user will forget or discard the original document (405) upon retrieving photocopies from the photocopier apparatus (400).

In some embodiments, the diverter device (435) may not be selectively engaged, but rather comprise a permanent modification or fixture in a photocopier apparatus (400). In such embodiments, original documents (405) may always be output together with the photocopied print media (410).

In some embodiments, the diverter device (435) may comprise a molded plastic piece designed for inclusion in a new photocopier apparatus or as a modification to an existing photocopier apparatus. In other embodiments, the diverter device (435) may be made out of metal, a composite material, or any other suitable material. Furthermore, in some embodiments, stepper motors, servo motors, solenoids, electromagnets, and/or other means to selectively engage and disengage the diverter device (435) may be included with the diverter device (435).

Figure 6:
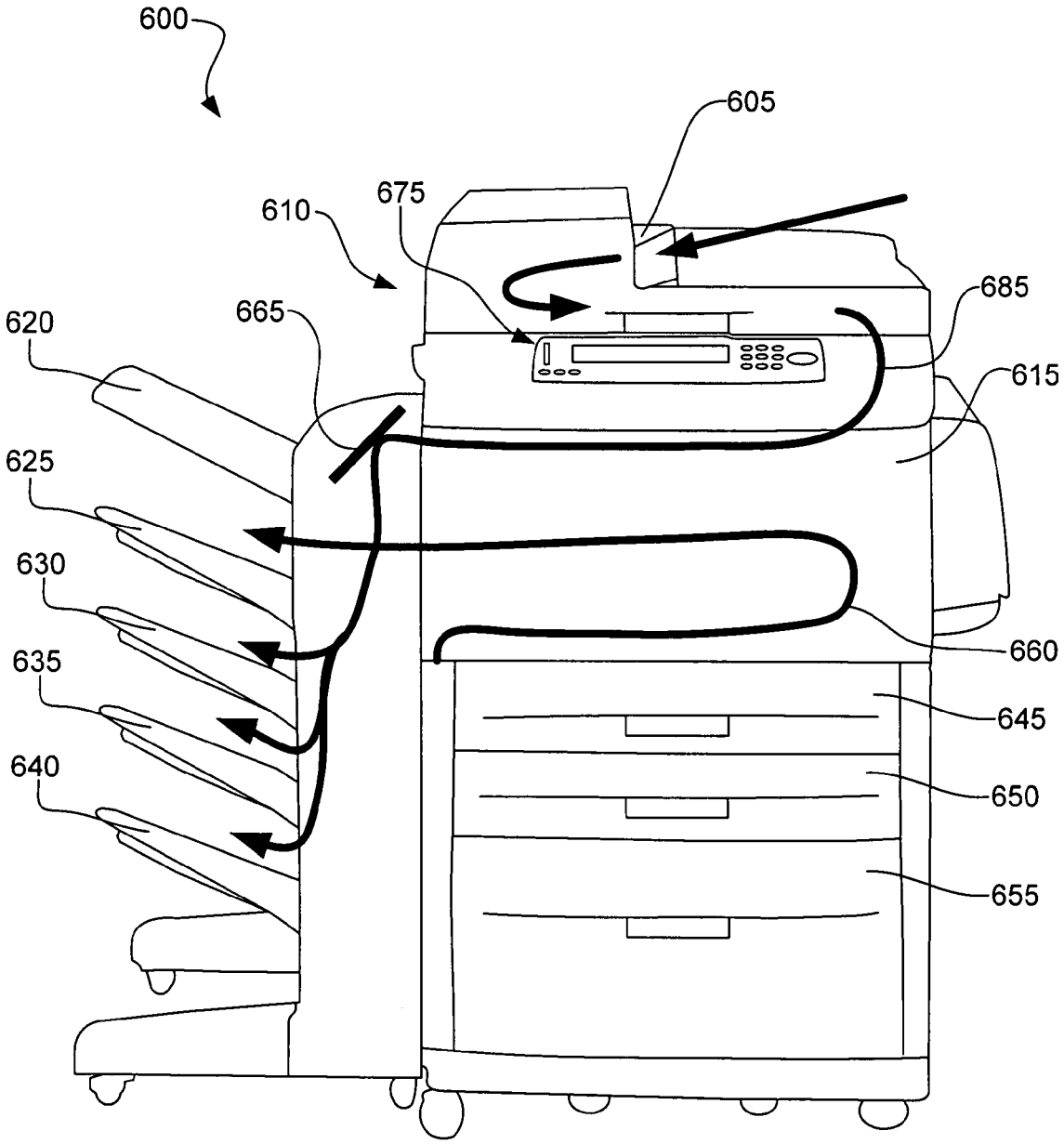
FIG. 6 is an illustration of an exemplary photocopier apparatus, according to principles described herein.

Referring now to FIG. 6, an exemplary embodiment of a photocopier apparatus (600) having a diverter device (665) is shown. The photocopier apparatus (600) comprises a plurality of media output trays (620, 625, 630, 635, 640). An original document tray (620) of the exemplary embodiment may be configured to receive original documents once the original documents have been received into an automatic document feeder (605) and passed through a scanning portion (610) of the photocopier apparatus (600).

When engaged, the diverter device (665) diverts an original document feed path (685) from exiting the photocopier apparatus (600) at the original document tray (620) to exiting at one of the media output trays (625, 630, 635, 640) configured to also receive photocopied print media bearing images from the original document.

A photocopy feed path (660) of the exemplary embodiment is configured to transport blank print media from trays (645, 650, 655) through a printing portion (615) of the photocopier apparatus (600) where an image representative of the original document is printed on the print media. After printing, the photocopy feed path (660) transports the media to any one of the photocopy output trays (625, 630, 635, 640) depending, in some examples, on the copy settings made by the user with the user interface (675).

The diverter device (665) may be selectively engaged or disengaged according to parameters relating to a photocopy job that may be set by a user. Users may specify parameters of a particular photocopy job by interacting with the user interface (675). In some embodiments, the user may select through the user interface (675) whether he or she desires the original document to exit the photocopier apparatus (600) at the designated original output tray (620) or together with one or more photocopied documents in one or more of the photocopied media output trays (625, 630, 635, 640). According to the parameters selected by the user, the photocopier apparatus (600) may then engage or disengage the diverting device (665) to accommodate the user's selection.

Exemplary Method

Figure 7:
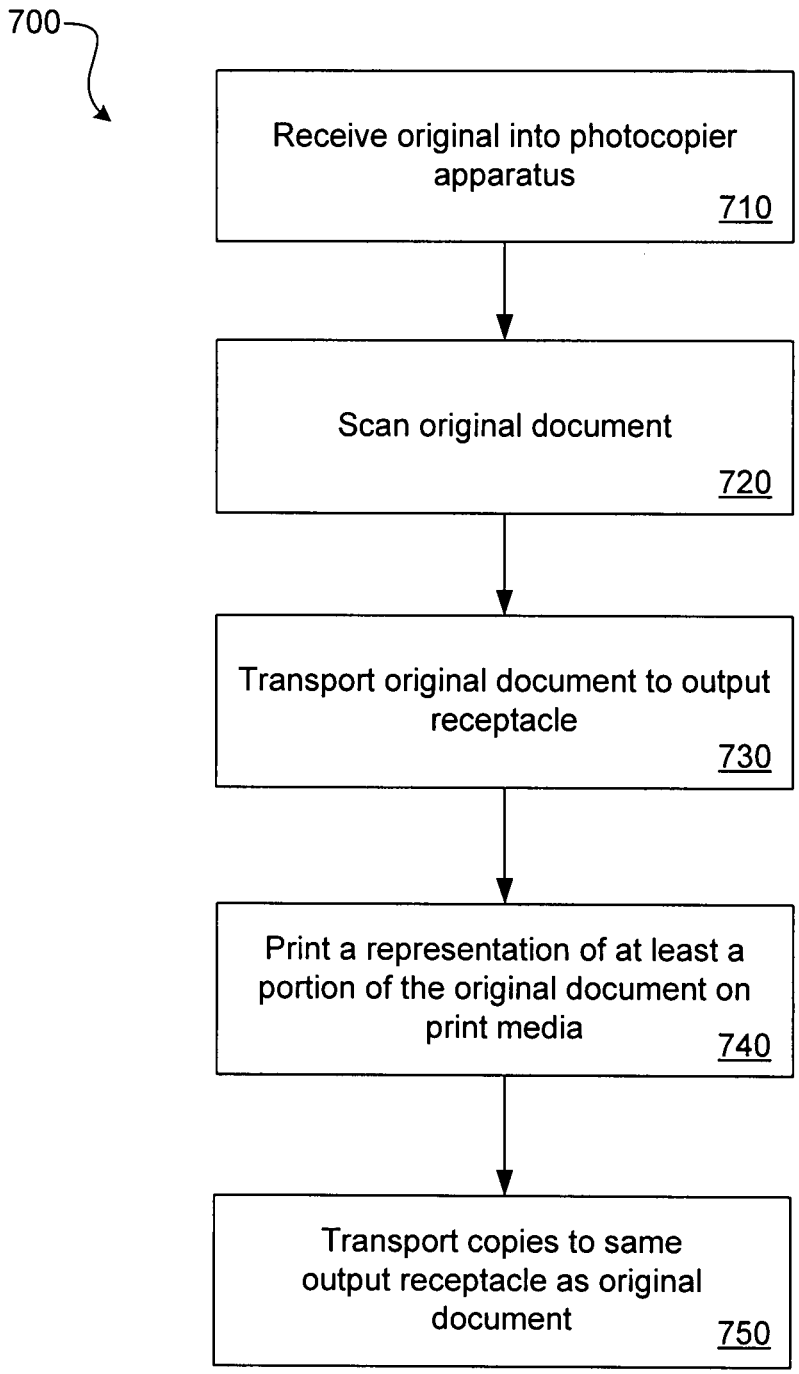
FIG. 7 is a flowchart illustration of an exemplary method of producing a photocopy according to principles described herein.

Referring now to FIG. 7, an exemplary method (700) of producing a photocopy or photocopies of an original document is shown. The method (700) includes the steps of receiving (step 710) an original document into a photocopier apparatus. The original document may be received into the photocopier apparatus using an automatic document feeder. In other embodiments, the original document may be received into the photocopier apparatus by a user manually placing an original document, perhaps page by page, in the photocopier apparatus.

Upon receiving (step 710) the original document into the photocopier apparatus, the original document is then scanned (step 720). In scanning the original document, a digital or analog representation of the visual characteristics of the original document is produced.

The original document is transported (step 730) to an output receptacle such as an output tray in the photocopier apparatus. The original document may be transported (step 730) using an original document feed path that utilizes drums, belts, vacuum pressure, and/or the like to accomplish the transportation of paper media. In some embodiments, one of a plurality of output receptacles may be selected for the original document feed path to exit.

A representation of at least a portion of the original document is printed (step 740) on print media. The print media may be blank media obtained from a tray in the photocopier apparatus. In some embodiments, the steps of transporting (step 730) the original document to the output receptacle and printing (step 740) a representation of at least a portion of the original document on the print media may be performed concurrently.

The print media are then transported (step 750) to the same output receptacle as the original document. A user may then retrieve the original document together with printed representations of the original document from the same output receptacle.

It should be noted that the various media feed paths described herein can be configured to deposit the original document together in collated form either before or after the copy or copies are deposited in the same output receptacle or location. A user may prefer to have the original document, with the pages retained in the original order, deposited before or after a copy or copies of the document are output to the same location.

In some embodiments, the method (700) may further include the step of diverting the original document from an original document feed path to a photocopy feed path exit. To accomplish this diversion, a diverter device may be present in the photocopier apparatus. In some embodiments, the method (700) further includes the step of engaging the diverter device to divert the original document to the photocopy feed path exit.

Furthermore, many sheets of print media may be used to print a plurality of representations of the original document. The plurality of representations may include duplicates copies, or in other embodiments, photocopies of other aspects of the original document. The method (700) may further include the step of collating separate pages of a multipage original document together with print media having printed images derived therefrom.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A photocopier apparatus, comprising:

a scanning module configured to scan an original document;

a document feeder configured to individually feed pages of a multiple-page original document to said scanning module;

a printing module configured to print a copy of said original document using output from said scanning module; and a media feed path configured to transport all pages of said multiple-page original document and said copy to a single output receptacle, where said pages of said multiple-page original document are delivered together to said single output receptacle separate from said copy.

2. The photocopier apparatus of claim 1, wherein said media feed path is configured to transport said original document to said output receptacle either before or after transporting said copy to said single output receptacle.

3. The photocopier apparatus of claim 1, wherein said printing module is configured to produce multiple copies of said original document and deliver each of said multiple copies to a different output receptacle.

4. The photocopier apparatus of claim 3, wherein said media feed path is configured to transport said original document and at least one of said multiple copies to said single output receptacle.

5. The photocopier apparatus of claim 1, wherein said photocopier apparatus further comprises at least one of a page collation mechanism, page stapling mechanism, hole punching mechanism, page alignment mechanism, page orienting mechanism, or a combination thereof.

6. A photocopier apparatus, comprising:

an original document feed path having a first exit;

a photocopy feed path having a second exit, wherein said second exit is separate from said first exit; and a diverter device configured to divert an original document from said original document feed path to exit said photocopier apparatus at said second exit.

7. The photocopier apparatus of claim 6, wherein said diverter device comprises an engaged setting and a disengaged setting.

8. The photocopier apparatus of claim 7, wherein said diverter device is configured to engage or disengage according to user input.

9. The photocopier apparatus of claim 6, further comprising an automatic document feeder configured to automatically load an original document into said photocopier apparatus.

10. The photocopier apparatus of claim 6, wherein said photocopy feed path comprises a plurality of exits, each of said exits being different from said first exit.

11. The photocopier apparatus of claim 10, wherein said diverter device is configured to divert said document from said original document feed path to any of said photocopy feed path exits.

12. A method of producing a photocopy of an original document, said method comprising:

receiving multiple pages of said original document into a document feeder of said photocopier apparatus;

printing a copy of said original document on print media; and transporting each page of said original document to a different media output tray along with at least one copy of that page, such that each page of said original document is sorted into a different media output tray along with copies thereof.

13. The method of claim 12, further comprising diverting said original document from an original document feed path to a photocopy feed path exit.

14. The method of claim 13, further comprising engaging a diverter device to divert said original document from said original document feed path to said photocopy feed path exit.

* * * * *